United States Patent [19]

Harms

[11] 3,990,474

[45] Nov. 9, 1976

[54] FLOW DIVERTER ARRANGEMENT FOR DOWNSPOUT

[76] Inventor: John F. Harms, 6418 Stonybrook Drive, Fort Wayne, Ind. 46815

[22] Filed: June 13, 1975

[21] Appl. No.: 586,644

[52] U.S. Cl. ..... 137/611; 61/15; 52/16

[51] Int. Cl.[2] ..... E04D 13/08; C02B 8/04

[58] Field of Search ..... 61/14, 15, 29, 18, 12; 52/16; 137/611, 612

[56] References Cited

UNITED STATES PATENTS

| | | | |
|---|---|---|---|
| 96,478 | 11/1969 | Perkins | 137/611 |
| 608,765 | 8/1898 | Epple | 137/611 |
| 946,634 | 1/1910 | Curtis | 137/611 |
| 2,030,467 | 2/1936 | Pearce | 137/611 |

*Primary Examiner*—Jacob Shapiro
*Attorney, Agent, or Firm*—Albert L. Jeffers; Roger M. Rickert

[57] ABSTRACT

A flow divertor arrangement, especially for the downspout of roof guttering, by means of which rain water can be diverted from the downspout and collected for uses requiring soft water. The arrangement has an inoperative position in which water flows in a conventional manner in the downspout and an adjusted position in which at least a substantial portion of water flowing in the downspout is diverted to a location external of the downspout where the water can be collected for use.

5 Claims, 5 Drawing Figures

FLOW DIVERTER ARRANGEMENT FOR DOWNSPOUT

The present invention relates to an arrangement for diverting water in a conduit, especially for diverting water in a downspout leading from roof guttering, and is particularly concerned with such an arrangement wherein the diverter is movable between operative and inoperative positions.

Soft water, especially in the form of rain water, is highly useful for use in connection with watering plants, in washing clothing and hair, in steam irons, in preparing photographic solutions and the like. Rain water is generally abundant but is not easy to collect because most home guttering is designed to convey rain water away from a dwelling and to deliver it directly into sewer lines or drainage ditches or the like. This is actually required in certain places, and where the requirement is written into the code, it is generally the case that the rain water is required to be discharged into underground pipes.

With the foregoing in mind, a primary objective of the present invention is the provision of a relatively simple and inexpensive diverting device that can be installed in a downspout and which can be adjusted to divert water flowing in the downspout to an external place where the water can be collected for any of the several uses referred to above, or for other uses where soft water, and especially rain water, is particularly advantageous.

Another object is the provision of the nature referred to which requires the minimum in modification of a conventional downspout and which can relatively simply be adjusted between an inoperative position wherein the downspout permits water to pass directly therethrough to an operative position wherein at least a portion of the water in the downspout is diverted to an external location to permit collection thereof.

BRIEF SUMMARY OF THE INVENTION

According to the present invention, a downspout, or a downspout section adapted to be inserted in a downspout, is provided with an aperture in a side wall. The downspout is advantageously rectangular and the aperture is slightly more narrow than the downspout, or downspout section, in which it is disposed.

The diverter element proper is in the form of a plate having a first portion inside the downspout and a second portion extending through the aperture and disposed outside the downspout. The first portion of the diverter plate is about the same width as the downspout and, thus, presents shoulders which engage the downspout adjacent the lateral edges of the aperture, thus, retaining the diverter plate captive in the downspout. The aperture may be rectangular and has a horizontal extending lower edge on which the diverter plate rests and about which edge the plate is tiltable.

In one tilted position of the diverter plate, the first portion thereof which is inside the downspout extends substantially vertically upwardly along the inside of the downspout while the protruding second portion of the diverter plate extends substantially vertically downwardly along the outside of the downspout. A stud may be provided in the downspout engaging a slot in the free end of the second portion and a wing nut on the stud is operable to clamp the diverter plate in the above-mentioned position and in which position the aperture is covered and water can pass freely down the inside of the downspout.

When the diverter plate is unclamped, it tilts backwardly in the downspout so that the first portion thereof which is inside the downspout extends across the downspout in an upwardly angled position while the second portion outside the downspout extends downwardly at an angle. Water flowing down the downspout is, thus, diverted by the diverter plate through the aperture and can be collected where it runs off the protruding second portion of the diverter plate.

The second portion of the diverter plate is preferably concave upwardly to form a flow directing channel while the free end of the first portion of the diverter plate is advantageously bent upwardly so as to take a flat bearing on the side of the downspout adjacent thereto when the diverter plate is tilted into operative position.

The exact nature of the present invention will become more apparent upon reference to the following detailed specification taken in connection with the accompanying drawings in which.

DETAILED DESCRIPTION OF THE INVENTION

Figure 1:
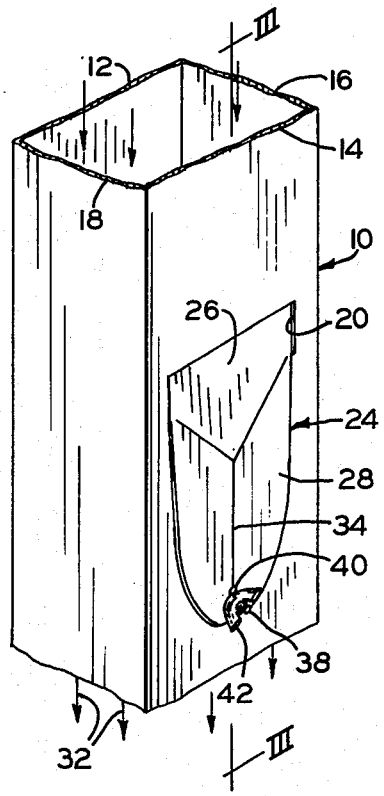
FIG. 1 is a perspective view showing a diverter device according to the present invention with the diverter plate in inoperative position.

Referring to the drawings more in detail, reference numeral 10 in the drawings indicates a downspout for the guttering of a building and which downspout, or downspout section, is preferably rectangular. The diverter device of the present invention can be employed by cutting a hole in an existing downspout or it can be utilized by forming a section of downspout, which may be a short section, with the diverter device incorporated therein.

In this last-mentioned case, the conventional downspout is interrupted and the section having the diverter device therein is inserted in place.

Figure 5:
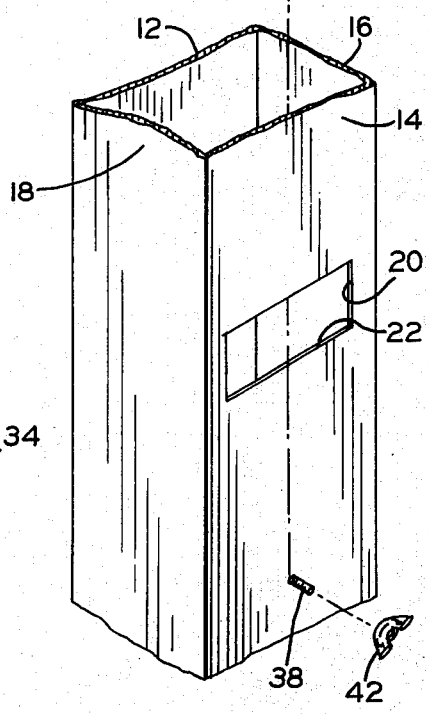
FIG. 5 is an exploded perspective view of the device according to the present invention.

In either case, the downspout has side walls 12 and 14 and end walls 16 and 18. An aperture 20 is formed in one side wall 14 and which aperture may be rectangular or any other suitable configuration but, preferably, has a horizontal lower edge as is indicated at 22 in FIG. 5.

A diverter plate 24 is provided which comprises a first portion 26 adapted to be disposed inside the downspout and a second portion 28 which is of about the same width of aperture 20 and which is adapted to protrude through the aperture as will be seen in FIGS. 1 to 4.

Figure 3:
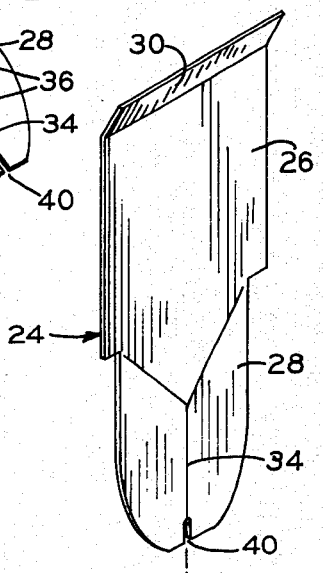
FIG. 3 is a vertical section indicated by line III—III on FIG. 1.
Figure 3:
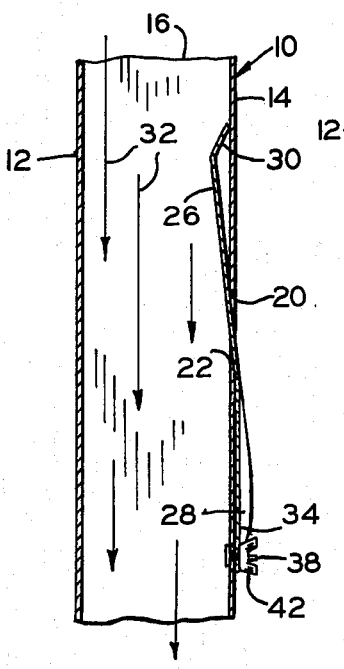

Portion 26 is of about the same width as the distance between walls 16 and 18 and at the free end has a portion 30 bent upwardly. As will be seen in FIGS. 3 and 4, the diverter plate 24 is movable from a first position and which is illustrated in FIG. 3 wherein the aperture 20 is closed and the diverter plate lays close along the side wall 14 of the downspout. In this position of the diverter plate, water can flow freely downwardly through the downspout as indicated by arrows 32.

Figure 4:
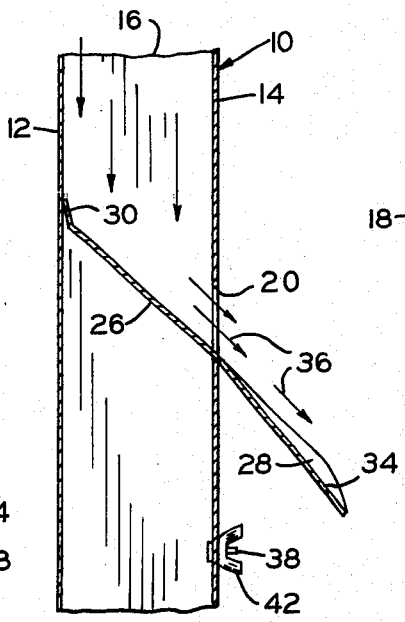
FIG. 4 is a vertical section indicated by line IV—IV on FIG. 2.

The diverter plate is tiltable about lower edge 22 of the aperture 20 into the position shown in FIG. 4 and wherein turned up end portion 30 rests against side wall 12 of the downspout. When the diverter plate is so tilted, the first portion 26 thereof inclines upwardly at an angle across the downspout while the second portion 28 thereof inclines downwardly at an angle on the outside of the downspout.

Portion 28, it will be noted, is formed so as to define an upwardly opening channel 34 for water. When the diverter plate is in its FIG. 4 position, water flowing down the downspout from above the diverter plate will be diverted outwardly through aperture 20 as indicated by arrows 36 in FIGS. 2 and 4.

Mounted in side wall 14 of the downspout in a position spaced downwardly from aperture 20 is a threaded stud 38 which is engageable with a slot 40 formed in the free end of the second portion 28 of the diverter plate. The stud is adapted for receiving a wing nut 42 which can be employed for clamping the diverter plate in its FIGS. 1 and 3 position.

Figure 2:
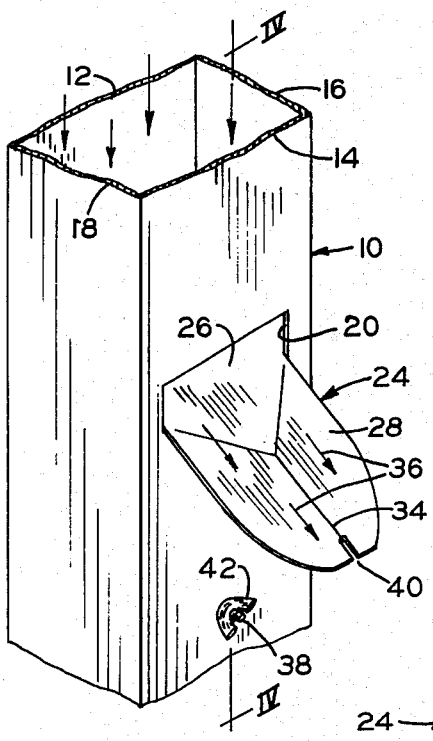
FIG. 2 is a view like FIG. 1 but shows the diverter plate tilted into operative position.

By removing the wing nut, or by loosening the wing nut and lifting the diverter plate upwardly, it can be disengaged from the stud and wing nut and then swung outwardly to its FIGS. 2 and 4 position.

The downspout section, when a special section is provided in which the diverter plate is incorporated, could conveniently be about 10 to 15 inches in length.

The aperture in the side of the downspout can vary in size, but may be about 2 ¾ inches wide by ¾ inches high.

The stud in the downspout may be positioned about 2 ¾ inches below the bottom edge of the aperture.

Modifications may be made within the scope of the appended claims.

What is claimed is:

1. For use in combination with a rectangular downspout section having end and side walls for roof guttering and having an aperture formed in a side wall of the downspout section, said aperture having side edges spaced inwardly from the end walls of the downspout section and also having a bottom edge, a diverter plate receivable in the aperture, said diverter plate having a first portion disposable inside the downspout and a second portion disposable outside the downspout, said diverter plate including shoulder means for engaging the downspout on the inside laterally outwardly from the side edges of the aperture whereby the diverter plate may rest on the bottom edge of the aperture, the first portion having a width substantially equal to the distance between the end walls of the downspout section and said second portion having a width substantially equal to the distance between the side edges of the aperture, said diverter plate being tiltable in the aperture and having a first position wherein said first portion may incline angularly upwardly across the inside of the downspout while the second portion may incline angularly downwardly outside the downspout and a second position wherein said first portion may extend substantially vertically inside the downspout while said second portion may extend substantially vertically downwardly outside the downspout, said second portion being formed so as to be concave upwardly to form a channel for water diverted by the diverter plate in the first position thereof, and means for detachably retaining said diverter plate in said second position.

2. The combination according to claim 1 in which the free end of said second portion is bent upwardly so as to rest flat against the inside of the side wall of the downspout section which is opposite the aperture when the diverter plate is in its said first position.

3. The combination according to claim 1 in which said means for retaining said diverter plate in the said second position thereof comprises a central axial slot formed in the free end of said second portion of the diverter plate and having stud means protruding from the downspout section and engageable with said slot when said diverter plate is in the said second position thereof.

4. The combination according to claim 3 in which said stud means is threaded, and a wing nut threaded thereon.

5. The combination according to claim 1 in which said aperture is rectangular, said second portion of said diverter plate overlying and closing said aperture when said diverter plate is in said second position thereof, and exposing said aperture for the flow of water therethrough when said diverter plate is in said first position thereof.

* * * * *